US005195279A

United States Patent [19]

Wern

[11] Patent Number: 5,195,279

[45] Date of Patent: Mar. 23, 1993

[54] STENCILING APPARATUS WITH SYSTEM FOR RECYCLING STENCILING MATERIAL

[75] Inventor: Michael J. Wern, Mokena, Ill.

[73] Assignee: Engineered Abrasives, Inc., Worth, Ill.

[21] Appl. No.: 843,905

[22] Filed: Feb. 27, 1992

[51] Int. Cl.[5] ..... B24C 3/02; B24C 9/00

[52] U.S. Cl. ..... 51/415; 51/424; 51/310; 51/319

[58] Field of Search ..... 101/114, 126, 129; 51/310, 311, 312, 418, 424, 425, 426, 415, 319

[56] References Cited

U.S. PATENT DOCUMENTS

| | | | |
|---|---|---|---|
| 1,916,633 | 7/1933 | Mulvany et al. | 51/418 X |
| 2,450,401 | 9/1948 | Thompson | 51/310 X |
| 3,518,795 | 7/1970 | Haider et al. | 51/415 X |
| 3,545,996 | 12/1970 | Duncan | 51/310 X |
| 4,164,183 | 8/1979 | Peck | 51/424 X |
| 4,314,503 | 2/1982 | Perra, Jr. et al. | 101/114 X |
| 4,432,169 | 2/1984 | Schultz et al. | 51/424 |
| 4,470,226 | 9/1984 | Williams | 51/310 X |
| 4,825,598 | 5/1989 | Schlick | 51/424 X |
| 4,897,969 | 2/1990 | Balhorn | 51/310 X |

*Primary Examiner*—Clifford D. Crowder

*Attorney, Agent, or Firm*—Trexler, Bushnell, Giangiorgi & Blackstone, Ltd.

[57] ABSTRACT

A stenciling apparatus for stenciling a predetermined pattern on a workpiece by directing stenciling material involved with forced air against the workpiece comprises a stenciling chamber and a suction device. The suction device is operatively connected to the stenciling chamber by means of a pipe for providing suction to the stenciling chamber. The stenciling chamber includes a housing and a stenciling box shiftably mounted within the housing. The stenciling box is shiftable between a first position for operatively engaging the workpiece for stenciling, and a second position for allowing movement of the workpiece into and out of the stenciling chamber. The box has a first opening and a second opening therein with a funnel being connected to the first opening for allowing air to be sucked into the box, and with the second opening being connected to the pipe such that when the suction device provides suction, air will be sucked into the box through the funnel, the air will catch up the stenciling material, and the air and the caught up stenciling material will be sucked out of the box through the pipe, thereby cleaning the box.

25 Claims, 3 Drawing Sheets

STENCILING APPARATUS WITH SYSTEM FOR RECYCLING STENCILING MATERIAL

BACKGROUND AND SUMMARY OF THE INVENTION

The present invention relates generally to a new and improved construction for an etching or stenciling apparatus.

The construction and operation of etching or stenciling apparatuses are well known to those having ordinary skill in the relevant art. These apparatuses are used to perform a variety of tasks, such as etching a pattern on a piece of glass or other material, as well as other similar operations. In this capacity, the stenciling apparatus can etch a serial number, or other product information, directly on a workpiece or component of a larger assembly. For example, the stenciling apparatus can be employed in marking picture tubes with product identifying information before those tubes are assembled into a television or a computer monitor.

While the stenciling apparatuses of the prior art perform their functions adequately, they present certain drawbacks which make them unattractive to some users. In these prior art apparatuses, a workman has to properly position each workpiece to be stenciled or etched individually against the stencil of the apparatus. Once the workpiece is properly positioned, forced air bearing an appropriate abrasive or stenciling material, such as sand or the like, is directed against the workpiece through the stencil, thereby etching a pre-determined pattern on the workpiece.

Due to the number of steps that must be performed by the workman in stenciling the workpiece, the production time required to manufacture and to etch a workpiece is increased. Also, at least one workman should be employed to position each workpiece, while another may be employed to control and to monitor direction of the forced air. Furthermore, the stencil can become clogged, resulting in apparatus down time while a workman cleans the stencil. Thus, utilization of the prior art apparatuses is costly in time and manpower.

The stenciling apparatus, constructed according to the teachings of the present invention, is intended to solve, or assist in solving, at least some of these drawbacks.

OBJECTS AND SUMMARY OF THE INVENTION

A general object of the present invention is to provide a new and improved construction of a stenciling apparatus.

A more specific object of the invention is to provide a stenciling apparatus which utilizes a general box-within-a-box construction.

Another object of the present invention is to provide a stenciling apparatus which operates substantially automatically.

An additional object of the invention is to provide a stenciling apparatus having a self-cleaning stencil.

A further object of the present invention is to provide a stenciling apparatus which utilizes high velocity fluid flow turbulence to clean the apparatus of stenciling material.

A stenciling apparatus, constructed according to the teachings of the present invention, for stenciling a predetermined pattern on a workpiece by directing stenciling material involved with forced air against the workpiece comprises a stenciling chamber and a suction device. The suction device is operatively connected to the stenciling chamber by means of a pipe for providing suction to the stenciling chamber. The stenciling chamber includes a housing and a stenciling box shiftably mounted within the housing. The stenciling box is shiftable between a first position for operatively engaging the workpiece for stenciling, and a second position for allowing movement of the workpiece into and out of the stenciling chamber. The box has a first opening and a second opening therein with a funnel being connected to the first opening for allowing air to be sucked into the box, and with the second opening being connected to the pipe such that when the suction device provides suction, air will be sucked into the box through the funnel, the air will catch up the stenciling material, and the air and the caught up stenciling material will be sucked out of the box through the pipe, thereby cleaning the box.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which.

DETAILED DESCRIPTION OF THE PREFERRED EMBODIMENT

Figure 1:
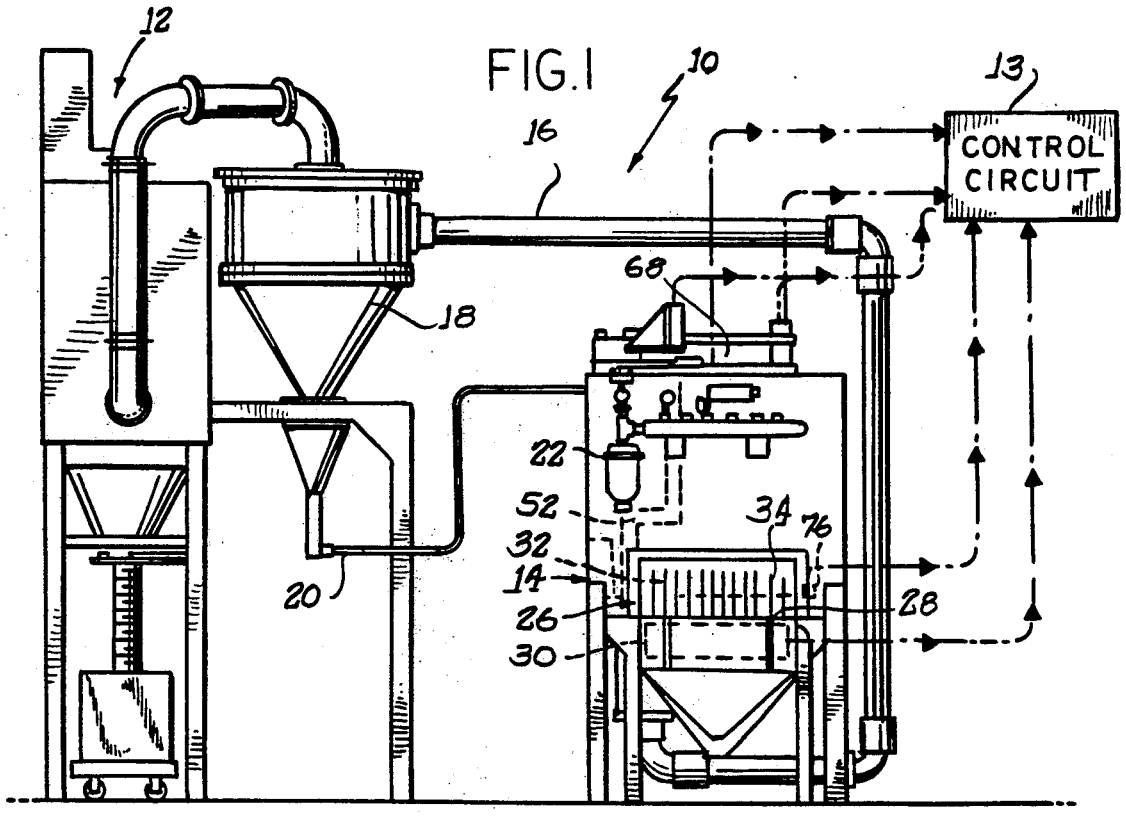
FIG. 1 is a diagrammatic view of a stenciling apparatus constructed according to the teachings of the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Referring initially to FIG. 1, a new and improved stenciling apparatus 10, constructed according to the teachings of the present invention, is illustrated in diagrammatic form. The stenciling apparatus 10 generally comprises a suction device 12 and a stenciling chamber 14. The operation of the apparatus 10 is monitored and controlled by a control circuit 13, as will be discussed hereinafter.

The suction device 12 provides high velocity suction to the stenciling chamber 14 by means of a pipe 16 operatively connected between the stenciling chamber 14 and the suction device 12. Preferably, the pipe 16 is composed of a material, such as urethane and the like, which is somewhat resistant to damage caused by interaction with high velocity stenciling material.

The suction device 12 includes a centrifugal separator 18 for separating, by known methods, stenciling material or shot, such as sand or the like, from a stream of forced air drawn to the suction device 12 through the pipe 16 from the chamber 14, as will be discussed hereinafter. Thus, the pipe 16 is connected between the separator 18 and a bottom end of the chamber 14. A collecting end of the separator 18 is connected to the chamber 14 by means of a reclaim tube 20 so that stenciling material separated from the forced air by the separator 18 can be recycled, thereby resulting in additional cost savings to the apparatus operator.

Figures 2, 3:
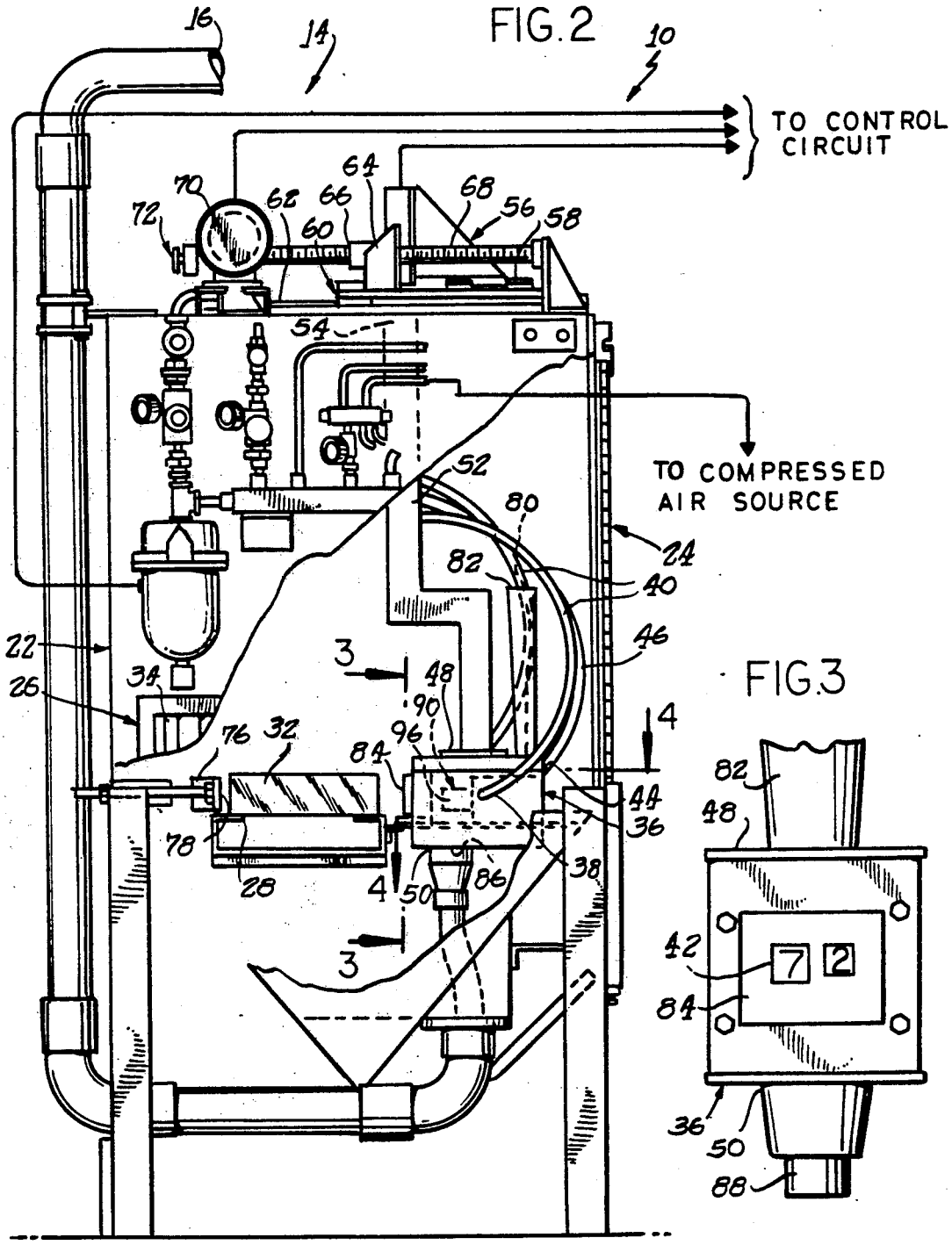
FIG. 2 is a side elevational view of the stenciling housing with a portion thereof broken away revealing a stenciling box and related elements of the apparatus.
FIG. 3 is a sectional view, taken along line 3—3 of FIG. 2 with an actuation shaft removed, showing the construction of a stencil held in the stenciling box.

As shown generally in FIG. 1 and as illustrated more specifically in FIG. 2, the stenciling chamber 14 utilizes a general box-within-a-box construction having means for facilitating substantially automatic operation of the apparatus 10. The chamber 14 comprises a generally box-like housing 22 having an access door 24 and a pair of conveyor doors 26 located on opposing sides of the housing 22. The access door 24 is large enough to allow a workman access to the interior of the housing 22 for servicing and maintenance of the chamber 14.

The conveyor doors 26 are located in substantially linear alignment on opposite sides of the housing 22 so that a conveyor belt 28, driven by rollers 30 on opposite ends thereof, can extend through the chamber 14. The operation of the rollers 30, and thus the movement of the conveyor belt 28, is appropriately controlled by the control circuit 13. The conveyor belt 28 is of sufficient dimensions to allow a workpiece 32 to be placed thereon and automatically moved into the chamber 14 for stenciling. After the workpiece 32 has been stenciled or etched, the conveyor belt 28 can move the workpiece 32 out of the chamber 14 for further processing.

To prevent stenciling material from exiting the chamber 14 during the etching process, a curtain 34, composed of rubber or other suitable material, covers each conveyor door 26, but is attached at only one side thereof to the housing 22. Thus, the workpiece 32 is allowed to move in and out of the chamber 14 by pushing the curtain 34 out of its path as the workpiece 32 enters and exits the housing 22 through the doors 26. After the workpiece 32 has passed the curtain 34, the curtain 34 returns towards its original, conveyor door covering position. Because the motion of the conveyor belt 28, as well as other elements of the apparatus 10, is controlled automatically by the control circuit 13, the operation of the apparatus 10 becomes substantially automatic, and is an improvement over the prior art apparatuses, resulting in greater cost savings to the operator.

A stenciling box 36 is disposed within the housing 22 adjacent a longitudinal edge of the conveyor belt 28. The stenciling box 36 is substantially box-like in configuration, thus constituting the box-within-a-box construction of the chamber 14 (the first box being the box 36 and the second box being the housing 22). In a preferred construction, the mask, or box, 36 has at least two side ports 38 disposed through opposite sides of the box 36. These side ports 38 accept supply tubes 40 for supplying stenciling material to the interior of the box 36, as will be discussed further below.

The box 36 also has an outlet defined by a stencil 42 and a pair of back ports 44 on opposite sides thereof. The stencil 42 and the back ports 44 are offset substantially ninety degrees on the surface of the box 36 from the side ports 38. The back ports 44 accept air tubes 46 for supplying forced air. The stencil 42 is of known construction, and allows a pre-determined pattern, such as a product or serial number, to be etched on the workpiece 32. Because the back ports 44 are opposite to the stencil 42, the positioning of the back ports 44 facilitates directing forced air bearing or involved with stenciling material at the stencil 42, as will be discussed hereinafter.

The box 36 has a top panel 48 and a bottom panel 50 joining the sides through which the ports 38 and 44 and the stencil 42 are disposed. The top panel 48 is connected to an actuation arm 52 extending upwardly from the box 36 through the housing 22. The actuation arm 52 extends from the top panel 48 of the box 36 upwardly and through the housing 22. Specifically, an end of the arm 52 opposite to the end thereof connected to the box 36 extends through a slot 54 located in the top of the housing 22, where the arm 52 is connected to carriage means for positioning the box. The slot 54 is configured and elongated so that the arm 52 may shift linearly between a first or forward position where the box 36 operatively engages the workpiece 32 for stenciling or etching, and a second or retracted position where the box 36 is offset from the workpiece 32, thereby allowing the conveyor belt 28 to move the workpiece 32 into and out of the chamber 14.

Figure 5:
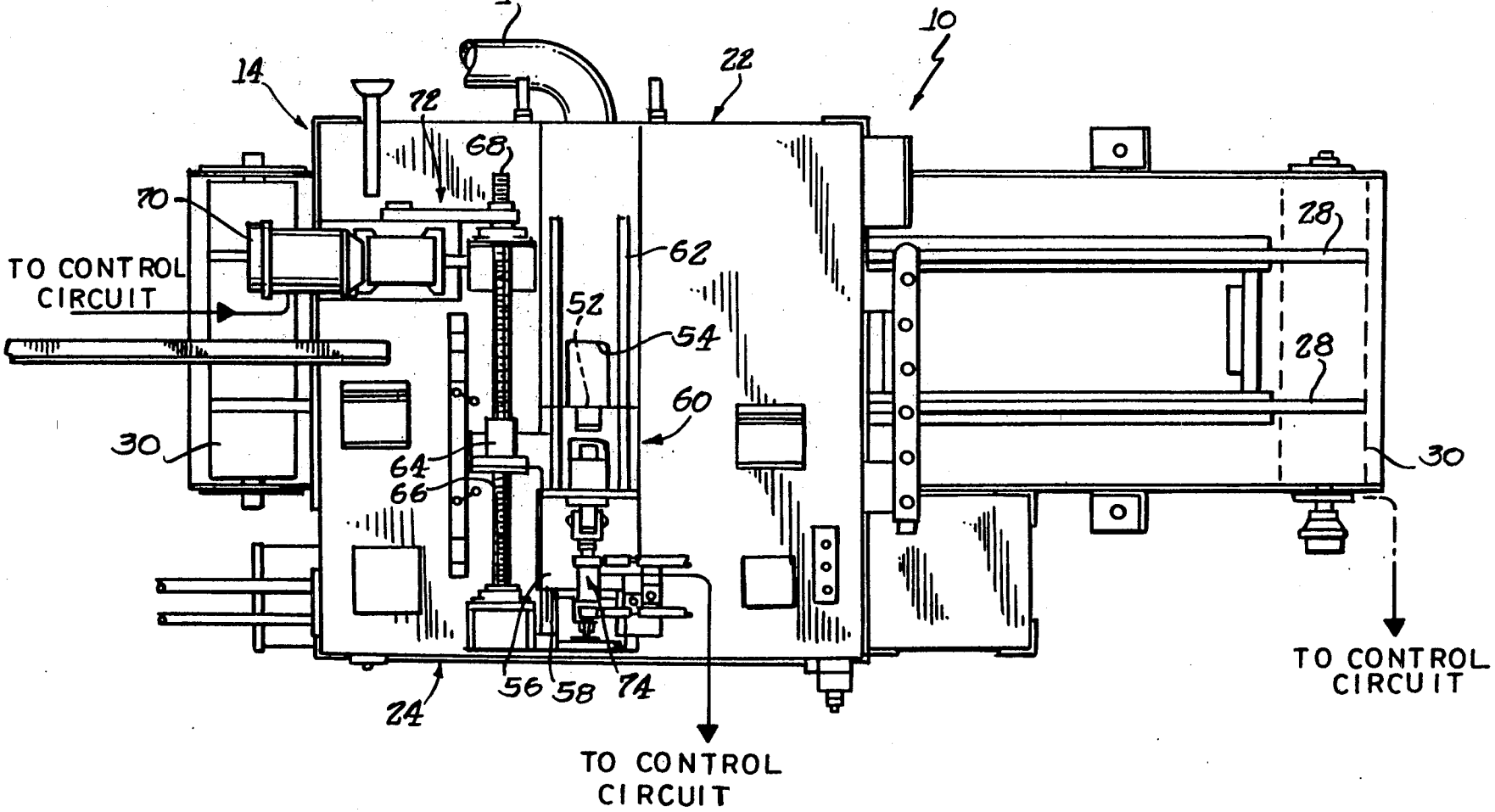
FIG. 5 is a top plan view of the stenciling housing.

Preferred embodiments of the top of the housing 22 and the means for positioning the box are illustrated more clearly in FIGS. 2 and 5. As seen there, the arm 52 extends through the slot 54 and is fixedly connected to carriage means comprising a first carriage 56, which is slidably mounted on a second carriage 60 by a first pair of rails 58. The second carriage 60 is, in turn, slidably mounted on the top of the housing 22 by a second pair of rails 62. As the carriages 56 and 60 slide along the rails 58 and 62, respectively, the arm 52 moves linearly therewith between the first and second positions, as will be discussed hereinafter. The second pair of rails 62 extends along the top of the housing 22 in a direction substantially perpendicular to the direction of movement of the conveyor belt 28 a distance sufficient to accommodate movement of the arm 52 between the first and second positions. The second pair of rails 62 flanks the slot 54. The second carriage 60 is constructed for facilitating its sliding movement along the rails 62.

The second carriage 60 has a body 64 extending away from one side thereof in a substantially perpendicular fashion such that the direction of body 64 extension is substantially parallel to the direction of the conveyor belt 28 in a preferred construction. The body 64 has an internally threaded bore 66 therein for accepting a drive screw 68 extending substantially parallel to the slot 54 and the rails 58 and 62. Threads on the drive screw 68 cooperate with the threads in the bore 66 so that rotation of the drive screw 68 causes linear movement of the second carriage 60 as the body 64 moves along the threaded shank of the screw 68. The drive screw 68 has a length sufficient to accommodate the range of necessary movement of the second carriage 60.

One end of the drive screw 68 is operatively connected to a drive motor 70 by means of a belt and pulley assembly 72. The drive motor 70 is thus able to induce rotation of the drive screw 68, thereby causing linear movement of the shaft 52 within the slot 54. The drive motor 70 is electrically connected to the control circuit 13 so that the operation thereof can be carefully monitored and controlled. Accordingly, the control circuit 13 determines when the drive motor 70 is to run, and for what duration of time. This is desirable in order to make the operation of the apparatus 10 substantially automatic.

The first carriage 56 is mounted on the second carriage 60 by the first pair of rails 58 such that the first carriage 56 moves in unison with the second carriage 60 under the influence of the drive motor 70. The first carriage 56 is also capable of movement independent of the second carriage 60. Specifically, a pneumatic cylinder 74 is operatively connected between the first and second carriages 56 and 60.

The pneumatic cylinder 74 is capable of causing the first carriage 56 to slide along the first pair of rails 58 after the drive motor 70 has ceased to operate. Therefore, the arm 52 is capable of linear movement under the influence of the pneumatic cylinder 74 within the slot 54 after deactivation of the drive motor 70. This two-stage movement of the arm 52 provides distinct advantages, to be discussed in greater detail later, in stenciling procedures. The pneumatic cylinder 74 is also electrically connected to the control circuit 13 for controlling operation thereof. As will be discussed below, the control circuit 13 operates the drive motor 70 and the cylinder 74 at distinctly different times to produce the distinct advantages offered by the apparatus 10.

To facilitate automatic operation of the drive motor 70 and the cylinder 74 for proper positioning of the workpiece 33 for stenciling or etching, a sensor 76 is provided within the housing 22 adjacent a side of the conveyor belt 28 opposite to the box 36 in such a manner that an imaginary line extending latitudinally across the conveyor belt 28 will intersect both the stencil 42 and the sensor 76. The sensor 76 has a sensor element or arm 78 operatively engagable by the workpiece 32 when the same is appropriately engaged by the box 36 for stenciling. The sensor 76 is electrically connected to the control circuit 13 for determining the operation of the apparatus 10, and importantly, the respective duration of operation of the drive motor 70 and the cylinder 74, thereby assuring proper positioning of the box 36 for stenciling. It is to be noted that other constructions for the sensor 76 can also be used without departing from the scope of the invention.

Figure 4:
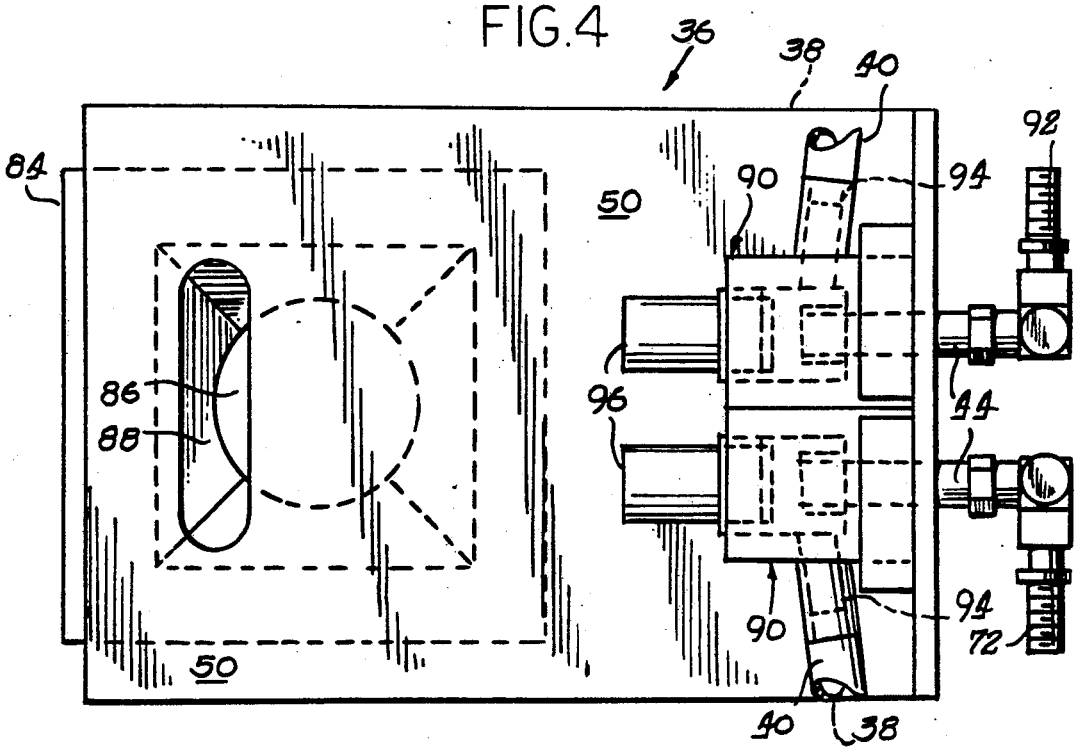
FIG. 4 is an enlarged sectional view, taken along line 4—4 of FIG. 2, illustrating the construction of a bottom plate of the stenciling box and of stenciling guns enclosed within the box.

The unique construction of the box 36 is illustrated in FIGS. 2, 3 and 4. Referring to FIGS. 2 and 3, the box 36 has a first opening 80, preferably on the top panel 48, allowing access to the interior of the box 36 to which a funnel 82 is connected. The opening 80 and the funnel 82 are located on the top panel 48 adjacent the back ports 44. The funnel 82 is constructed and attached to the opening 80 for allowing air from the interior of the housing 22 to enter the box 36.

The stencil 42 is clearly visible in FIG. 3. The stencil 42 is of known construction, and is configured so as to allow stenciling material, such as sand and the like, projected by a blast of air to engage and to etch the workpiece 32, forming a desired, predetermined pattern on the workpiece 32. The stencil 42 is surrounded by a material, such as urethane and the like, which is somewhat resistant to damage resulting from interaction with stenciling material. This material forms a buffer 84 which actually contacts and engages the workpiece 32 to be stenciled. The buffer 84 assists in preventing stenciling material from leaving the box 36.

The box 36 has a second opening 86, preferably on the bottom panel 50, also allowing access to the interior of the box 36. The opening 86 is constructed substantially similarly to the opening 80, but is located on the box 36 offset forwardly of the opening 80, and beneath the stencil opening. A flexible duct 88, shown in FIGS. 2 and 3, is connected between the opening 86 and an end of the pipe 16 opposite to the end thereof connected to the suction device 12. The flexibility of the duct 88 allows for shifting of the box 36 along with the arm 52 between the first and second positions, while maintaining operative connection between the pipe 16 and the box 36.

Because the opening 80 acts as an air inlet and the opening 86 acts as an air outlet, when the suction device 12 is activated by the control circuit 13, air within the housing 22 is drawn at a high velocity through the funnel 82, into the box 36 causing fluid turbulence, and out through the opening 86 and the duct 88 to the suction device 12. Air can also be drawn through the stencil 42 and through the duct 88 in similar fashion. The high fluid flow through the funnel 82 produces a venturi effect to produce high fluid velocity and turbulence, which is sufficient to remove stenciling material, such as sand and the like, from the box 36 and the stencil 42. Thus, after etching is complete, stenciling material remaining within the box 36 or stencil 42 will be drawn away from the chamber 14 towards the suction device 12, where it can be separated and recycled. Therefore, the box 36 and the stencil 42 are essentially self-cleaning, thereby preventing clogging of the stencil 42, and reducing the amount of down time needed to clean the apparatus 10, thereby possibly resulting in greater revenues to the operator.

The internal construction of the box 36 is illustrated in FIG. 4. As shown, the opening 86 in the bottom plate 50 is located adjacent the side of the box 36 bearing the stencil 42. Any stenciling material which falls from the stencil 42 into the interior of the box 36 will be caught up in the high velocity fluid flows entering the opening 86.

Stenciling guns 90 are located within the interior of the box 36 for mixing stenciling material with forced air and directing that mixture towards the stencil 42 to etch a predetermined pattern on the workpiece 32. The guns 90 include a first set of nipples 92 which protrude through the back ports 44 of the box 36, and are connected to the air tubes 46. The guns 90 also include a second set of nipples 94 connectible with the supply tubes 40 extending through the side ports 38. Thus, both stenciling material and forced air are supplied to the guns 90, where they are mixed in a known fashion. Furthermore, the guns 90 include adjustable nozzles 96 for varying the direction of stenciling material mixed with forced air towards the stencil 42.

The supply tubes 40 extend from the nipples 94 through the ports 38, out of the box 36 and out of the chamber 14. An end of the tubes 40 opposite to the end thereof connected to the nipples 94 is connected to a manifold, not shown for clarity, which is, in turn, connected to a source of stenciling material and the reclaim tube 20. Thus, the manifold allows stenciling material from both the source and the reclaim tube 20 to be supplied to the box 36. This conserves stenciling material and assists in reducing operator costs.

The air tubes 46 extend from the nipples 92 out of the chamber 14. An end of the air tubes 46 opposite to the end thereof connected to the nipples 92 is connected to a switch, not shown, but preferably of the solenoid type, which controls forced air flow to the box 36. The solenoid switch is connected to the control circuit 13 so that the entire operation of the apparatus 10 can be controlled substantially automatically.

Clarifying the construction and functionality of the above-disclosed elements by means of example, after a workman places the workpiece 32 to be stenciled on the conveyor belt 28, the conveyor belt 28, as controlled by the control circuit 13, moves the workpiece 32 under the curtain 34 and into the stenciling chamber 14. The control circuit 13 monitors the operation of the conveyor belt 28 so that the workpiece 32 is moved into a predetermined proper position for stenciling.

When the workpiece 32 has reached the predetermined proper position for stenciling within the chamber 14, the control circuit 13 stops the conveyor belt 28. The workpiece 32 rests upon the belt 28 between the box 36 and the sensor 76. The box 36 is in the second or retracted position with the box 36 being offset from the workpiece 32. Then, the control circuit 13 energizes the drive motor 70, causing rotation of the screw 68.

As the screw 68 rotates, the threads thereon and the threads in the bore 66 cooperate, and the body 64 moves along the shank of the screw 68. As the body 64 moves along the shank, the first and second carriages 56 and 60 move together with the arm 52, thereby causing the box 36 to move from the second position towards the first or advanced position where the box 36 operatively engages the workpiece 32 for stenciling. However, because the workpiece 32 is usually composed of glass, or other similarly fragile material, it is not desirable to have the box 36 contact the workpiece 32 under the influence of forces generated by the drive motor 70. The drive motor 70 may be able to exert a force of sufficient magnitude upon the workpiece 32 causing the workpiece 32 to break or to become damaged upon contact with the box 36.

Accordingly, the control circuit 13 terminates operation of the drive motor 70 while the box 36 is still some predetermined distance from the workpiece 32. At this point, the control circuit 13 energizes the pneumatic cylinder 74, thereby causing movement of the first carriage 56 and the arm 52 independent of the second carriage 60. The box 36 moves under the influence of forces generated by the cylinder 74 until the box 36 contacts and operatively engages the workpiece 32. The box 36 is pressed against the workpiece 32 by the cylinder 74 sufficiently to form a seal between the buffer 84 and the workpiece 32. In this manner, stenciling material is prevented from leaving the strict confines of the box 36. Because the cylinder 74 is pneumatic, it provides a cushioned compression between the workpiece 32 and the box 36, thereby assuring that the workpiece 32 will not be damaged by contact with the box 36 when the box 36 moves into the first position.

In a preferred construction, the slot 54 is approximately ten inches in length. Thus, the maximum range of movement of the box 36 and the arm 52 between the first and second positions is that same ten inches. The drive motor 70 operates to move the arm 52 approximately eight inches from the retracted position. Then, the control circuit 13 stops the drive motor 70 and energizes the cylinder 74, which moves the arm 52 and the box 36 into the first or advanced position and into engagement with the workpiece.

The cushioned compression provided by the pneumatic cylinder 74 does not cause damage to the workpiece 32 when the box 36 is pressed against the workpiece. To further insure against damage to the workpiece 32, and to provide an indication to the control circuit 13 as to when the box 36 is in proper contact with the workpiece 32 for stenciling, the sensor 76 is provided.

When the workpiece 32 is engaged by the box 36, the box 36 moves transversely of the conveyor belt 28 and pushes the workpiece 32 against the arm 78 of the sensor 76. When the arm 78 is contacted sufficiently, indicative of the contact between the box 36 and the workpiece 32, the sensor 76 provides the control circuit 13 with an indication that proper engagement between the workpiece 32 and the box 36 has been achieved. The control circuit 13 then deactivates the cylinder 74, and the apparatus 10 is ready to stencil the workpiece 32. It is to be noted that the length of travel of the box 36 and the arm 52, when driven by the drive motor 70 and the pneumatic cylinder 74, respectively, can be calibrated and predetermined to allow for workpieces having different dimensions. Also, the sensor 76 can be calibrated to cause the control circuit 13 to shut down either or both of the drive motor 70 and the cylinder 74 as necessary to prevent damage to the workpiece 32.

To stencil the workpiece 32, the control circuit 13 opens the solenoid switch which controls the flow of forced air to the guns 90. The forced air flows through the air tubes 46 and into the guns 90 where the air becomes involved with or catches up stenciling material supplied to the guns 90 through the supply tubes 40. The nozzles 96 direct the mixture of the air and the material at high speed towards the stencil 42 and the workpiece 32. The mixture stencils or etches the predetermined pattern on the workpiece 32. However, because of the seal between the workpiece 32 and the buffer 84, the stenciling material is prohibited from leaving the box 36.

The fluid flow through the nozzles 96 continues for a predetermined time period sufficient to properly stencil the workpiece 32. Once this time period has expired, the control circuit 13 closes the solenoid switch and the fluid flow ceases.

During the stenciling process, stenciling material falls from the stencil 42 onto the bottom panel 50, or may become embedded in the stencil 42 itself. To maintain a clean and tidy operation, and to prevent possibly harmful interaction between the stenciling material and the apparatus 10, it is desirable to remove that material. This is accomplished by sucking air at high velocities and high turbulence through the box 36.

The suction device 12, which is continuously operated, draws air from the interior of the chamber 14 into the box 36 through the funnel 82. The air flows through the funnel 82 and into the box 36 through the opening 80 in the top panel 48. The air is drawn through the box 36 and exits through the opening 86 in the bottom panel 50, where the box 36 is connected to the suction device 12 through the pipe 16 and the flexible duct 88.

Because the openings 80 and 86 are offset with respect to each other, the suction provided by the suction device 12 causes turbulence in the fluid flow path within the box 36 between the openings 80 and 86. The turbulence of the fluid flow causes the air drawn into the box 36 to encounter a substantial portion of the interior of the box 36, thereby causing the air to become involved with, and to catch up the stenciling material residing in the box 36. Thus, the interior of the box 36 is substantially cleared of stenciling material.

Additionally, air may be drawn into the interior of the box 36 through the stencil 42 in a direction opposite to that of stenciling material flow during the stenciling process. In this manner, the stencil 42 is also substantially cleared of stenciling material. The suction device 12 is operated for a predetermined time period sufficient to clear the box 36 of stenciling material. To enhance the draw of air through the stencil 42, the control circuit 13 may cause the box 36 to be moved away somewhat from the workpiece 32 while the suction device 12 is still operating.

Once the last-mentioned predetermined time period has elapsed, the control circuit 13 shuts off the suction device 12, and causes the box 36 to move into the second position by reversing the above-described box 36 shifting procedure. The control circuit 13 then energizes the conveyor belt 28, and the stenciled workpiece 32 exits the chamber 14 through the opposite conveyor door 26. Because the apparatus 10 can operate substantially automatically, the apparatus 10 is an improvement over the apparatuses of the prior art. Also, the apparatus 10 is self-cleaning, leading to further cost savings to the operator.

While a preferred embodiment of the present invention is shown and described, it is envisioned that those skilled in the art may devise various modifications of the present invention without departing from the spirit and scope of the appended claims. The invention is not intended to be limited by the foregoing disclosure, but only by the following appended claims.

The invention claimed is:

1. A stenciling apparatus for stenciling a predetermined pattern on a workpiece by directing stenciling material involved with forced air against the workpiece comprising: a stenciling chamber and a suction means operatively connected to the stenciling chamber for providing suction to the stenciling chamber; the stenciling chamber including a housing and a stenciling box shiftably mounted within the housing; the stenciling box being shiftable between a first position for operatively engaging the workpiece for stenciling, and a second position for allowing movement of the workpiece into and out of the stenciling chamber; the box having a first opening and a second opening therein; a funnel being connected to the first opening for allowing air to be sucked into the box; and the second opening being connected to the suction means such that when the suction means provides suction, air will be sucked into the box through the funnel, the air will catch up the stenciling material, and the air and the caught up stenciling material will be sucked out of the box.

2. A stenciling apparatus as defined in claim 1 wherein such suction means includes a separator for separating the stenciling material from the air drawn to the suction means; and a reclaim tube connecting the separator to the chamber for recycling the stenciling material.

3. A stenciling apparatus as defined in claim 1, which includes a conveyor for transporting workpieces into and out of such chamber, said housing having a conveyor door therethrough for accepting the conveyor; and a curtain allowing for passage of the workpiece through the conveyor door operatively covering the conveyor door.

4. A stenciling apparatus as defined in claim 1 wherein the stenciling box has a stencil of a construction corresponding to the predetermined pattern; a port for accepting a supply tube for supplying the box with stenciling material; a port for accepting an air tube for supplying the box with forced air; a nozzle disposed within the box connected to the supply tube and the air tube; and the nozzle being offset from the stencil for directing forced air and stenciling material towards the stencil for stenciling the workpiece.

5. A stenciling apparatus as defined in claim 4 wherein the first opening is located on the box adjacent the nozzle, and the second opening is located on the box adjacent the stencil.

6. A stenciling apparatus as defined in claim 1 further comprising an actuation arm connected to the box for shifting the box between the first and second positions; a slot disposed through the housing of dimensions sufficient to operatively accept the arm and to allow for shifting thereof between the first and second positions; and the arm extending from the box through the slot.

7. A stenciling apparatus as defined in claim 6 further comprising carriage means connected to the arm on an end thereof opposite to the end connected to the box for shifting the box between the first and second positions.

8. A stenciling apparatus as defined in claim 7 wherein the carriage means comprises a first carriage connected to the arm; a second carriage bearing first rails upon which the first carriage is slidably mounted; second rails disposed on the housing adjacent the slot upon which the second carriage is slidably mounted; the first carriage being capable of sliding movement with and independent of the second carriage; and the sliding movement of the first carriage on the first rails and the second carriage on the second rails shifting the box between the first and second positions.

9. A stenciling apparatus as defined in claim 8 wherein the second carriage includes a projecting body having an internally threaded bore; a screw threadibly inserted into the bore so that threads on the screw cooperate with threads in the bore to cause sliding movement of the second carriage on the second rails; and a drive motor operatively connected to the screw for causing cooperation of the threads on the screw with the threads in the bore.

10. A stenciling apparatus as defined in claim 9 further comprising a control circuit electrically connected to the drive motor for activating and deactivating the motor.

11. A stenciling apparatus as defined in claim 8, which includes a pneumatic cylinder operatively connected between the first and second carriages for causing sliding movement of the first carriage independent of the second carriage along the first rails.

12. A stenciling apparatus as defined in claim 11 further comprising a control circuit electrically connected to the pneumatic cylinder for activating and deactivating the cylinder.

13. A stenciling apparatus as defined in claim 8 wherein the second carriage includes a projecting body having an internally threaded bore; a screw threadibly inserted into the bore so that threads on the screw cooperate with threads in the bore for causing sliding movement of the second carriage on the second rails; a drive motor operatively connected to the screw for causing cooperation of the threads; and a pneumatic cylinder operatively connected between the first and second carriages for causing sliding movement of the first carriage independent of the second carriage along the first rails.

14. A stenciling apparatus as defined in claim 13 further comprising a control circuit for monitoring and controlling operation of the drive motor and the pneumatic cylinder; the control circuit causing the drive motor to operate independently of the pneumatic cylinder for shifting the box into and out of the second position; and the control circuit causing the pneumatic cylinder to operate independently of the drive motor for shifting the box into and out of the first position for providing cushioned contact between the box and the workpiece.

15. A stenciling apparatus as defined in claim 14 further comprising a sensor mounted within the housing so that the sensor is operatively contacted by the workpiece when the box is in the first position; and the sensor being electrically connected to the control circuit for providing an indication thereto that the box is in the first position thereby enabling the control circuit to deactivate the pneumatic cylinder.

16. A stenciling apparatus as defined in claim 1 further comprising a control circuit for monitoring shifting of the box between the first and second positions.

17. A stenciling apparatus as defined in claim 16 further comprising a sensor module mounted on the housing so that the sensor is operatively contacted by a side of the workpiece opposite to a side thereof engaged by the box when the box is in the first position; and the sensor being electrically connected to the control circuit for providing an indication thereto that the box is in the first position.

18. A stenciling apparatus as defined in claim 1 wherein the box has a stencil of a construction corresponding to the predetermined pattern; a buffer surrounding the stencil; and the buffer being sealingly engagable with the workpiece when the box is in the first position for preventing stenciling material forced against the stencil from exiting the box.

19. A stenciling apparatus as defined in claim 1 further comprising a flexible duct connected between the suction means and the second opening for maintaining operative connection between the suction means and the second opening as the box shifts between the first and second positions.

20. A stenciling box useful with a stenciling apparatus for stenciling a pattern on a workpiece, the box comprising: a first side panel having a forward end and a rearward end; a second side panel having a forward end and a rearward end; a face panel disposed between the first and second side panels forward ends; a stencil opening in said face panel; a nozzle disposed in the box opposite to an offset from the stencil opening, said nozzle having an opening at a forward end of the nozzle for directing stenciling material towards the stencil opening for forming the pattern; a first opening disposed through said first side panel near the rearward end of the first side panel, remote from the stencil opening and wholly behind the nozzle opening for allowing air to enter the box, and a second opening disposed through the second side panel near the forward end of the second side panel adjacent the stencil opening forward of the nozzle opening, and laterally offset with respect to the first opening for allowing air and stenciling material to exit the box, thereby producing air turbulence within the box for facilitating removal of the stenciling material from the box.

21. A stenciling box as defined in claim 20 further comprising a funnel connected to the first opening for allowing air to enter the box, and suction means operatively connected to the second opening for drawing air involved with stenciling material through the second opening.

22. A stenciling box as defined in claim 20 further comprising an actuation arm connected to the box for shifting the box between a first position and a second position; the first position being defined by the box operatively engaging the workpiece for stenciling; and the second position between defined by the box being offset from the workpiece, thereby allowing movement of the workpiece to and from the box.

23. A stenciling box as defined in claim 22 wherein said actuation arm being connected tot he first side panel forward of the first opening.

24. A stenciling box as defined in claim 20 further comprising a stencil mount around said stencil opening, and a buffer surrounding the stencil; and the buffer being sealingly engagable with the workpiece as the box engages the workpiece for preventing stenciling material forced against the stencil from exiting the box.

25. A stenciling box as defined in claim 20 wherein said face panel being disposed in a generally vertical direction.

* * * * *

UNITED STATES PATENT AND TRADEMARK OFFICE

CERTIFICATE OF CORRECTION

PATENT NO. : 5,195,279

DATED : March 23, 1993

INVENTOR(S) : Michael J. Wern

It is certified that error appears in the above-identified patent and that said Letters Patent is hereby corrected as shown below:

Column 12, Line 28 "position between defined" should read — position being defined —

Column 12, Line 32 "tot he" should read — to the —

Signed and Sealed this

Twenty-fifth Day of January, 1994

*Attest:*

*Attesting Officer*

BRUCE LEHMAN

*Commissioner of Patents and Trademarks*